United States Patent [19]

Bezard et al.

[11] Patent Number: 4,561,470

[45] Date of Patent: Dec. 31, 1985

[54] SERVO VALVE CONTROL DEVICE

[75] Inventors: Jean-Yves L. N. Bezard, Melun; Jean-Marie Brocard, Rubelles; Christian A. F. Parisel, Combs la Ville, all of France

[73] Assignee: Société Nationale d'Etude et de Construction de Moteurs d'Aviation, Paris, France

[21] Appl. No.: 724,357

[22] Filed: Apr. 18, 1985

[30] Foreign Application Priority Data

Apr. 18, 1984 [FR] France ..... 84 06099

[51] Int. Cl.[4] ..... F15B 13/043; F15B 9/07; F15B 20/00

[52] U.S. Cl. ..... 137/625.61; 91/363 A; 137/625.64; 251/261

[58] Field of Search ..... 91/363 R, 363 A; 137/625.61, 625.62, 625.64; 251/26

[56] References Cited

U.S. PATENT DOCUMENTS 3,018,794 1/1962 Hoge .
3,257,911 6/1966 Garnjost et al. ..... 137/625.62 X
3,437,312 4/1969 Jenney .
3,494,256 2/1970 Bioletti .
3,732,887 5/1973 Hayner ..... 137/625.62 X

FOREIGN PATENT DOCUMENTS 2178356 11/1973 France .
2388151 11/1978 France .
1369441 10/1974 United Kingdom .
2057718A 4/1981 United Kingdom .

*Primary Examiner*—Gerald A. Michalsky
*Attorney, Agent, or Firm*—Bacon & Thomas

[57] ABSTRACT

A control system for a fluid actuated control member is disclosed which utilizes a pair of electrically controlled servo valves to control the supply of servo pressure fluid to a control valve piston. The pair of servo valves are electrically controlled such that, under normal conditions, one of the servo valves is operative to supply the servo pressure signal, while the other servo valve remains in an inert, open position. Upon the detection of a malfunction in the operative servo valve, electrical switches render the malfunctioning valve inert and transfer the operative capabilities to the second servo valve. The hydraulic control system does retain 100% of its performance capabilities following a malfunction of the initial servo valve.

12 Claims, 4 Drawing Figures

SERVO VALVE CONTROL DEVICE

BACKGROUND OF THE INVENTION

1. Field of the Invention

The present invention relates to a servo valve control system for a hydraulically actuated control member.

Hydraulically actuated control members and control systems incorporating such members, which may be a hydraulic jack or the like, are well known and have found usage in virtually all types of apparatus. Basically, these systems involve a control valve, which controls the flow of the hydraulic fluid to/or from the hydraulic jack and a servo valve which controls the position of the control valve by regulating a servo pressure applied to the positioning elements of the valve.

Servo valve controls are known which include a movable blade disposed at the end of a movable rod which extends through an opening in a spring tube which is fixed, at one end, on a base and which is free at its opposite end. The rod is supported by a transverse element which is movable through one or more electrical drive coils. When a current energizes the drive coils, the blade moves between a pair of nozzles which are each connected to a control chamber of the control valve so as to vary the pressure within the control chambers and, consequently, change the position of the control valve.

Although such devices have been relatively effective, they have the serious drawback of being very sensitive to any pollution present in the servo valve fluid. The small diameter of the servo valve nozzles coupled with the small clearances between the nozzles and the blade (which may be several hundredths of a mm) allows any particles to jam the blade and prevent operation of the servo valve. These devices also suffer from the relative fragility of the spring tube caused by the vibration filled environment in which such devices are typically utilized. The breakage of such spring tube would, of course, render the servo valve totally inoperative.

One way of remedying these defects in the known servo valves, has been to include a plurality of them in the control system to provide a redundancy in case one or more should fail. Since most servo valves have double electrical windings it is relatively easy to accomplish the electrical redundancy that is necessary. However, it is much more difficult to provide two or more servo valves to control the same member insofar as it requires a system of hydraulic isolation to isolate the defective servo valve from the member being controlled. Without isolating the malfunctioning servo valve, it prevents the other servo valves from fully performing their operative function.

British Pat. No. 1,369,441 discloses an electrohydraulic control system wherein two parallel servo valves receive the same electrical control signals and simultaneously act on the same pressure chambers of an actuating member. Means are provided to detect an operational difference between the two servo valves and to generate an error signal. However, in case one of the servo valves malfunctions, the only actions made possible by such a system are either locking the actuating member in position or activating an emergency control to move the member into a specific position, or isolating one of the servo valves by means of a hydraulic switch slide.

U.S. Pat. No. 3,437,312 to Jenny describes a redundant control system which includes three computation channels associated with three comparators and two servo valves. The two servo valves are separated by a hydraulic selector which admits to the controlled hydraulic member fluid from the first servo valve and subsequently fluid from the second servo valve.

SUMMARY OF THE INVENTION

The present invention provides a servo valve control system which is capable of providing full servo control of the control valve even if one of the servo valves should fail or otherwise malfunction.

In the system according to the invention, the control valve which controls the hydraulically actuated control member is of the spool-valve type which includes pistons on either end of the spool which are slidably received in chambers, at least one of which receives a servo-pressure signal for controlling the movement of the spool. The servopressure signal is obtained between a high pressure zone and a low pressure zone by a hydraulic potentiometer having a fixed constriction and a constriction with a variable cross section. The latter constriction is defined by a pair of electrically actuated, hydraulic servo valves. The invention further includes means for generating the control signals as a function of set-point signals, whereby a single servo valve acts as the operative signal pressure generator, while the other servo valve remains inert. A malfunction detector which detects any malfunction in the operative servo valve is connected to the electronic control means such that, should any malfunction occur, the malfunctioning servo valve is rendered inert and the control pressure function is assumed by the other servo valve. When a servo valve is in the inert position, it evinces a predetermined flow cross-section. The electronic control means controls the two servo valves to assure their switching, between the drive and inert servo valves, thereby delivering a servo pressure signal without interruption.

In a preferred embodiment, the servo valves may have a single nozzle and a blade movable toward and away from the nozzle to control the fluid pressure generated by the nozzle. The extreme open position of the blade may be controlled by an adjustable stop means.

DETAILED DESCRIPTION OF THE PREFERRED EMBODIMENTS

Figure 1:
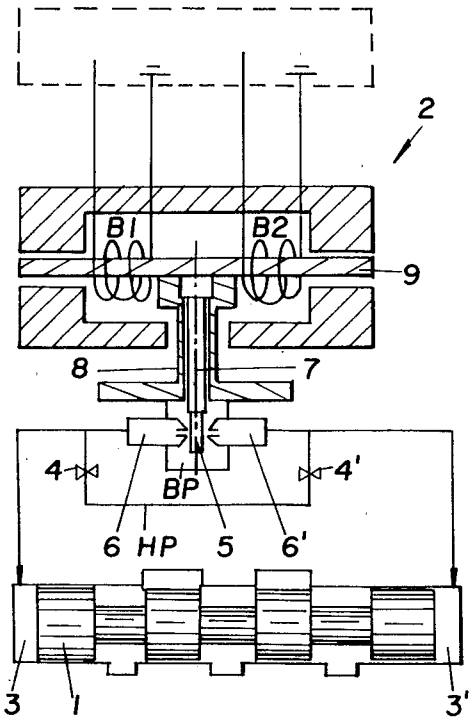
FIG. 1 is a schematic diagram illustrating a servo valve control system according to the prior art.

FIG. 1 shows a schematic diagram of a control system utilizing a servo control valve according to the prior art. The control valve has a spool slide 1, the position of which is controlled by means of servo valve 2 having a blade 5 which is movable between the double nozzles 6 and 6'. The two ends of spool slide 1 have equal cross-sectional areas and are slidably retained in chambers 3 and 3' defined by the housing of the control valve. Chambers 3 and 3', receive fluid through a hydraulic potentiometer formed between a high pressure source HP and a low pressure source BP. The hydraulic potentiometer has two fixed restrictions 4 and 4' and two nozzles 6 and 6' with variable cross-sections, each of the nozzles being connected in series with one of the restrictors 4 or 4'. The supply fluid for chambers 3 and 3' is picked up between one restrictor and one nozzle so that the pressure in the chambers is a pressure intermediate between the values of HP and BP. Nozzles 6 and 6' are arranged diametrically opposite one another on either side of a movable blade 5 and have their axes generally parallel so as to reduce or increase the fluid flow cross-section toward the low pressure area. In this manner a pressure differential is created between the chambers 3 and 3' which causes the slide spool 1 to move, thereby controlling the flow of actuating fluid to the hydraulic jack member.

Blade 5 is rigidly attached to rod 7 which is mounted within flexible tube 8 made of a thin, non-magnetic spring metal material. Tube 8 is fixed at one end to a fixed base (not shown). The tube also is attached to a movable soft iron bar 9 at its opposite end, such that iron bar 9 extends within electrical drive coils B1 and B2. As drive current is applied to the coils, blade 5 moves in one direction or the other between the nozzles 6 and 6 . In the absence of any drive current, the spring tube 8 maintains the movable blade 5 in a neutral position.

The servo valve control device as illustrated in FIG. 1 has proven to be somewhat unreliable insofar as it is highly sensitive to any pollution within the servo control fluid, since the distance between the nozzles 6 and 6' is very small (only several hundredths of a mm). A single particle lodging between the nozzle and the blade blocks any blade motion and, therefore, renders the servo valve inoperative. A second major cause of the servo valve malfunction is the breakage of the spring tube 8 due to the small dimensions of its wall thickness.

Figure 2:
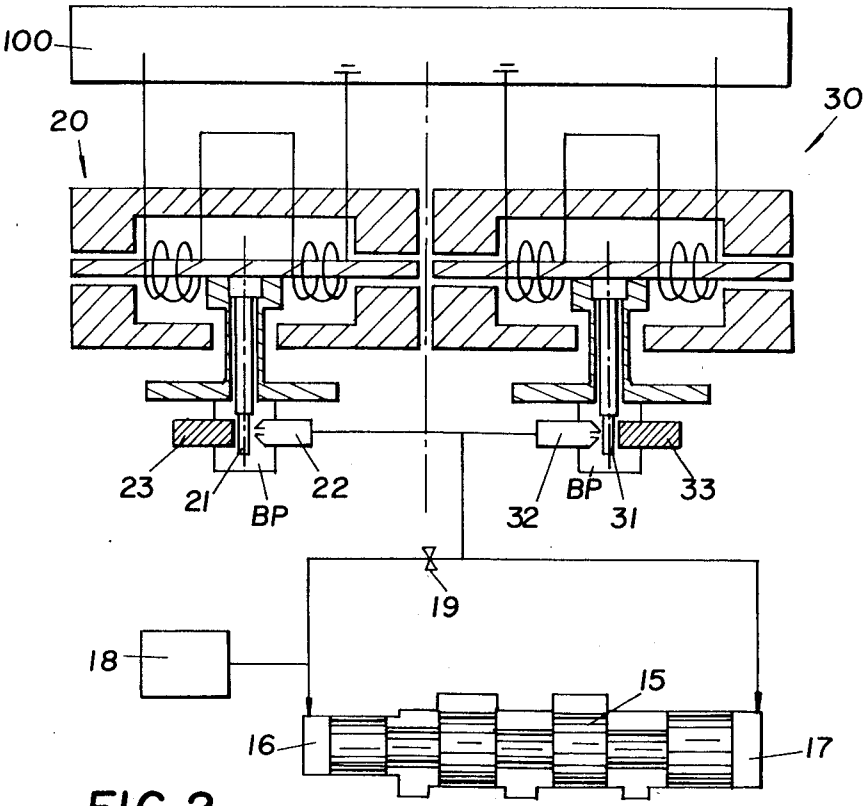
FIG. 2 is a schematic diagram of a first embodiment of the control system according to the invention.

The present invention cures these drawbacks of the prior art is shown in a first embodiment, in FIG. 2. The valve spool slide 15 has pistons formed on either end, however, such pistons have different cross-sectional areas. As in the prior art, the position of spool slide 15 controls the supply of operational fluid to a hydraulic jack driving a body which must be accurately positioned. Although no mechanical return means are shown as being associated with the spool slide 15, it should be that the invention may be also utilized in such a device where opposing springs are introduced into the control chambers 16 and 17 to exert a control force on the spool slide 15.

As shown, chamber 16 has the smaller cross-sectional area and communicates directly with fluid source 18, which generates a substantially constant fluid pressure. According to the invention, only the fluid pressure supplied to the opposite chamber 17 is modulated in order to position the spool slide 15. Fluid supplied to this chamber is picked up between the fixed restrictor 19 and a variable restrictor consisting of two single-nozzle servo valves 20 and 30. In the particular embodiment shown in FIG. 2, servo valves 20 and 30 are fluidically connected in parallel to each other. The design of the two servo valves 20 and 30 are similar to that of the previously described servo valve, however, each movable blade 21, 31 controls the flow for a single nozzle 22, 32. The opening movement of the blade 21, 31 is limited by mechanical stops 23, 33. The position of these stops may be adjusted in such a manner that the blade will be tangent to it from the force exerted thereon by the spring tube. In this position, a maximum flow cross-section is achieved. The servo valve elements are dimensioned in such a manner that, should a breakage of the spring tube occur, the blade will come to rest against the adjustable stops.

The windings of the torque motor of each servo valve is connected to an electronic control means 100. This system is designed to control only one of the two servo valves at any given time, leaving the other at rest in the full-open position. Therefore, in normal operation, the servo fluid pressure within chamber 17 is modulated by controllin9 the cross-section of only one nozzle, nozzle 22, for instance, the nozzle 32 providing a constant and predetermined leakage flow rate in the inert condition. In case of a malfunction of the nozzle 22, rendering the servo valve incapable of carrying out its function, the controlled member moves away from the nominal position regardless of the command imparted to the servo valve. In this case, the electronic control means 100 detects this deviation and immediately affects a switch-over to the previously inert servo valve. Thus, the second servo valve now becomes the operative servo valve and the malfunctioning servo valve becomes inert. In this new operational mode, nothing has changed with respect to the slide spool 15, since the nozzle 22 (of which the cross-section had previously been modulated) now provides a constant leakage flow equal to the prior leakage flow rate of the nozzle 32, and the control is insured by the nozzle 32 in the manner which had previously been caused by nozzle 22. Because the system according to the invention is without a hydraulic selector that would isolate one of the servo valves, the slide spool 15 permanently receives servo pressure fluids from the two servo valves 22 and 32.

Figure 3:
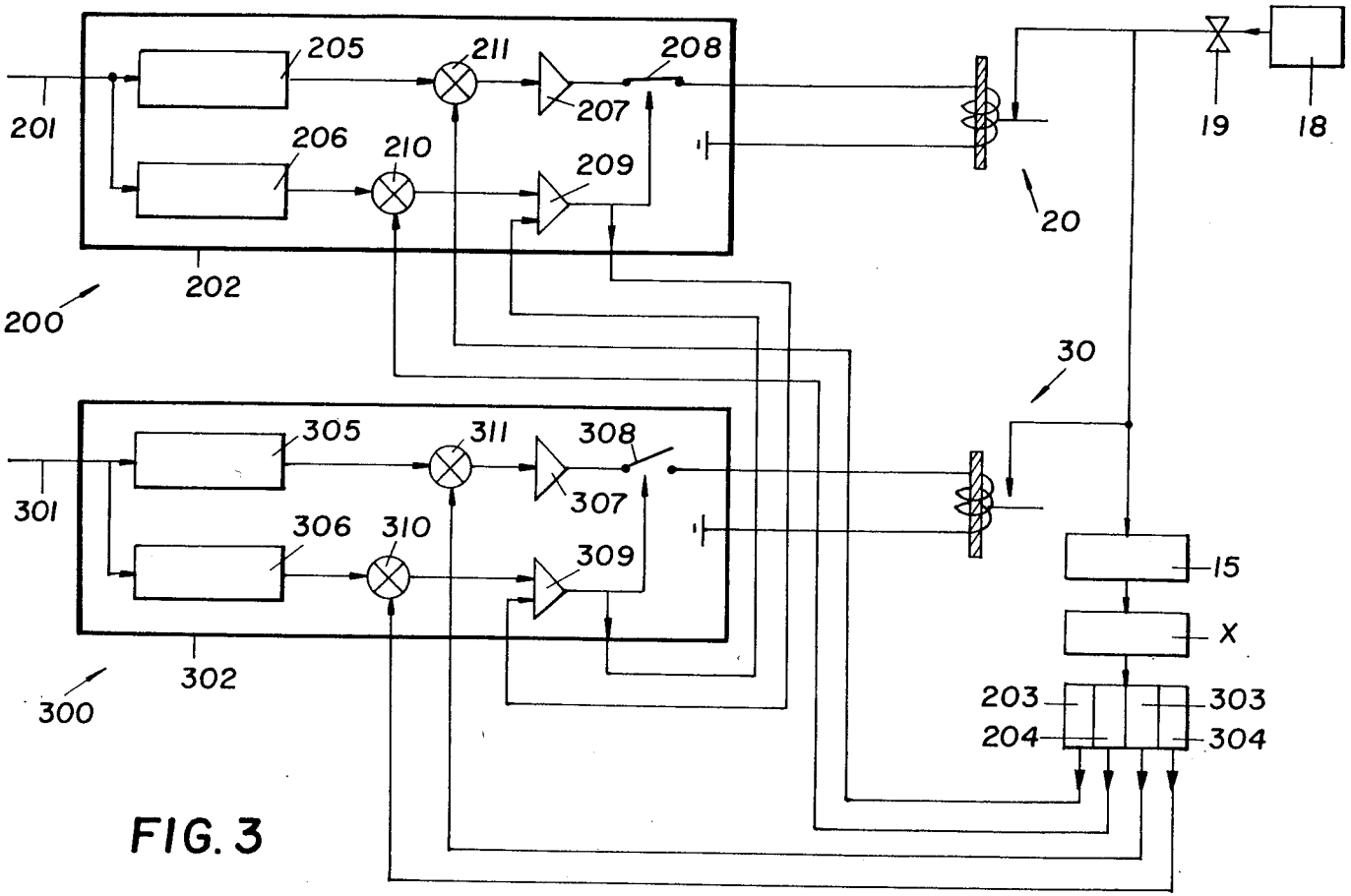
FIG. 3 is a schematic diagram showing the electrical control circuit for the servo valves in a system according to the invention.

FIG. 3 shows a schematic diagram of a typical electronic control system which may perform the switch over operation in case of a malfunction of the servo valve. The fluid source 18, servo valves 20 and 30, the fixed restriction 19 and the control valve 15 are all shown in FIG. 3. The control valve 15 controls the supply of hydraulic fluid to a hydraulic jack which drives the control body X, of which the displacement is measured by detectors. The control system 100 includes two completely separate electric control elements 200, 300, each having input 201, 301 for the predetermined, set point signals. Each of the elements comprises electronic circuit 202, 302 and a line connected to the torque motor winding of the corresponding servo valve 20, 30. Each of the control elements also receives signals from the position detectors 203, 204 and 303, 304 of the controlled member X.

Each control circuit 202, 302 includes two identical computers 205, 206 and 305, 306 which define the set point position as a function of the input data from lines 201 and 301. In each circuit, the first computer 205, 305 is used for the control function and emits a signal which is compared at comparators 211, 311, respectively with a signal corresponding to the actual position of the body X received from a first position detector 203, 303. The deviation signal is amplified in amplifier 207, 307, which output is connected to the winding of the corresponding torque motor by means of switches 208, 308. The position of switches 208, 308 responds to a signal from an adding amplifier 209, 309 one of the inputs of each of the amplifiers being connected to the output of the other amplifier. The second input line of each amplifier 209, 309 receives a signal corresponding to the deviation which is generated at 210 and 310 between the computed set point value of the second computer 206, 306 and the actual value of the position of the control body X as provided by second detectors 204, 304.

The system is electronically redundant since each controls circuit 200, 300 receives the same input signals and generates identical control signals. However, in normal operation, switch 208 is closed and switch 308, with a control inverse to that of 208, remains open such that only the servo valve connected to the first control circuit 200 is operative, the other servo valve remaining inert in the open position. If a malfunction occurs, the deviation signal between the value computed by 206 or 306 and the value provided by 204, or 304 will increase until it exceeds a predetermined threshold value. In that case, amplifiers 209 and 309 will emit control signals to invert the positions of the switches 308 and 208. Since the servo valve 20 is no longer operative, it becomes inert and the blade is brought back to rest against the adjustable stop. Servo valve 30 now becomes the operative servo valve and continues to provide a servo pressure signal to the slide spool 15. The switching between lines is bistable so that the control does not flip back to the first line when the deviation signal resumes a value which is less than the threshold value for actuating circuits 209, 309. Accordingly, the switchover applies only to the electronic control signals of the two servo valves, which together will permanently provide the required servo pressure signal.

In lieu of an electronically redundant system, a single control circuit with signal switching to the second servo valve in case of malfunction may be utilized if the servo valves are much less reliable than the electronics.

Figure 4:
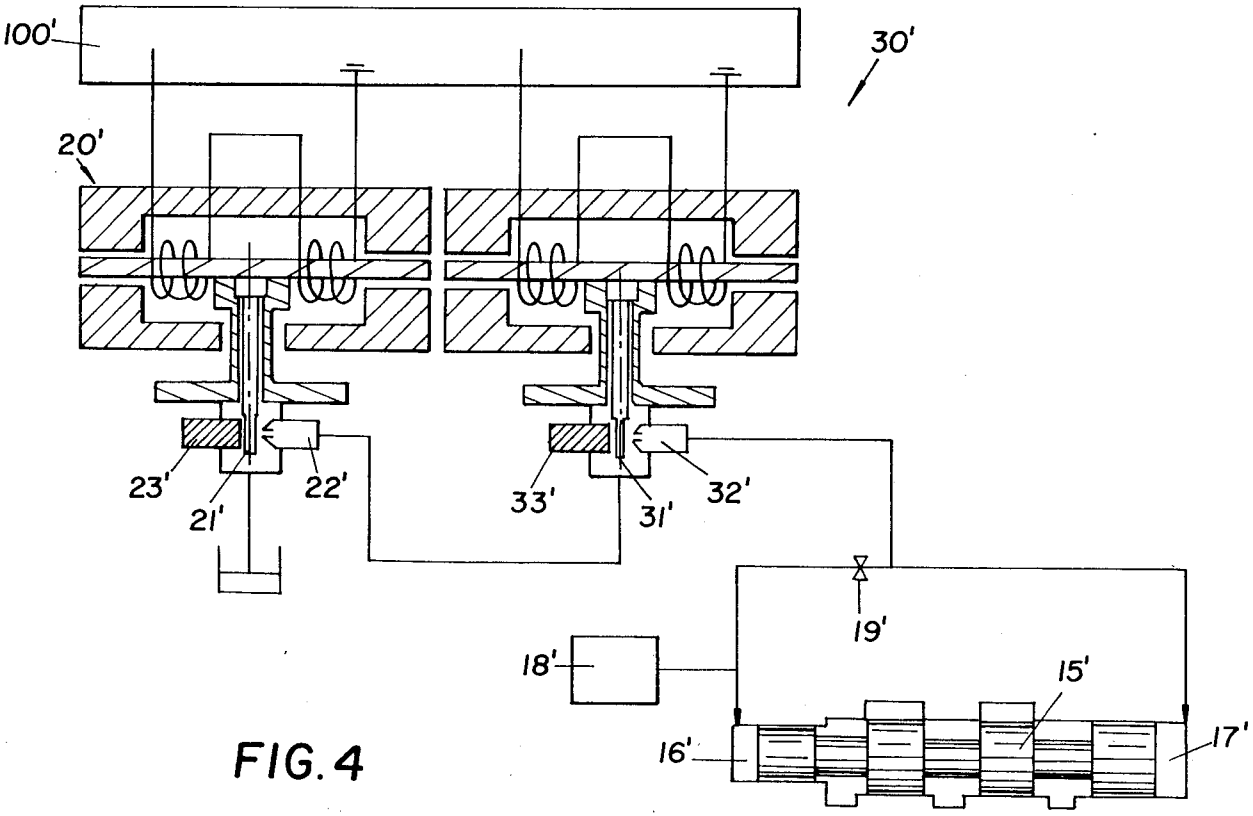
FIG. 4 is a schematic diagram of a second embodiment of the servo control system according to the invention.

A second embodiment of the invention is schematically illustrated in FIG. 4. The basic principle of operation is the same and the same elements as discussed above are similarly numbered, but referenced by a prime. In this embodiment, servo valves 20 and 30 are fluidically connected in series, as opposed to the embodiments shown in FIG. 2, wherein servo valves 20 and 30 are fluidically connected in parallel. As shown in FIG. 4, the servo pressure fluid flows from the HP pressure to the BP in a circuit in which the fixed restriction 19', the first servo valve 30' and the second servo valve 20' are arranged in series connection. The chamber 17' communicates with the fluid servo circuit between restriction 19' and servo valve 20'. In normal operation, the pressure of the servo fluid supplied to chamber 17' is controlled solely by the servo valve 20'. As the servo valve 30' is inert, the blade 31' rests against mechanical stop 33' and defines a fixed diaphram corresponding to the nozzle 32' cross-section. If a malfunction should occur, changing the normal operation of servo valve 20', electronic control circuit 100 renders the malfunctioning valve inert and it transfers the operative signals to servo valve 30' as described in the previous embodiment.

The electrohydraulic control device according to the invention accepts the first malfunction of the servo valve while retaining 100% of the operational capabilities of the system. At the same time, the device is relatively simple and the redundancy is provided while retaining the same number of nozzles as in a conventional servo valve device. The system requires no hydraulic switchover slide, since the switchover in this case is obtained electrically through simultaneous opening and closing of controlled switches. To a certain extent, the device is self-correcting. By switching over to the second servo valve, the first servo valve blade is made to move against the adjustable stop. The increase in distance between the nozzle and the movable blade makes it possible for any particles near the nozzle to clear themselves. In this instance, the first servo valve control becomes available for use should there be any malfunction of the second, operative servo valve.

Either the parallel or series connections, as previously discussed, may be applied to affect a redundant control of double-acting hydraulic jacks by using a set of two servo valves arranged in accordance with the invention.

The foregoing description is provided for illustritive purposes only and should not be construed as in any way limiting this invention, the scope of which is determined solely by the appended claims.

We claim:

1. A control system for a fluid actuated control member comprising:

(a) a control valve having a movable piston to control the flow of pressurized fluid to and from the control member;

(b) means for generating a servo pressure signal;

(c) connecting means to apply the servo pressure signal to the movable piston of the control valve;

(d) a pair of electrically controlled, fluidic servo valves fluidically connected to the connecting means and forming a variable cross-section restriction in the connecting means so as to control the pressure of the servo pressure signal delivered to the movable piston of the control member;

(e) electronic control means electrically connected to the fluidic servovalves to control the servovalves such that at any given time, one of the servovalves controls the servo pressure signal while the other servovalve remains inert; and, (f) means connected to the electronic control means to detect a malfunction of the operative servovalve, thereby causing the electronic control means to render the malfunctioning servovalve inert and to render the other servovalve operative to control the servo pressure signal.

2. The control system of claim 1 wherein each of the fluidic servovalves comprises:

(a) a single nozzle fluidically connected to the servo pressure signal;

(b) a blade extending in front of an opening in the nozzle;

(c) an adjustable stop bearing against the blade in its extreme open position; and, (d) means connecting the blade to the electronic control means such that, when the servovalve is operative, the blade may be moved toward or away from the nozzle so as to control the pressure of the servovalve signal, and, when the servovalve is inert, the blade is moved against the adjustable stop.

3. The control system of claim 2 where the nozzles of the fluidic servovalves are fluidically connected in parallel.

4. The control system of claim 3 wherein the movable piston has two ends of different diameter, each end slidably received in a cylinder of corresponding dimension, the means for generating a servo pressure signal supplies a substantially constant servo pressure signal to one end of the movable piston, and wherein the servovalves control the variable servo pressure signal applied to the opposite end of the movable piston.

5. The control system of claim 4 wherein the substantially constant servo pressure signal is applied to the smaller diameter end of the movable piston.

6. The control system of claim 5 wherein the electronic control means comprises: two independent electronic control circuits; electrical connecting means connecting each control circuit to one of the fluidic servovalves; switch means interposed between each control circuit and each fluidic servovalve; and; switch control means connected to each switch such that, at any given time, only one switch is closed.

7. The control system of claim 2 wherein the nozzles of the fluidic servovalves are fluidically connected in series.

8. The control system of claim 7 wherein the movable piston has two ends of different diameter, each end slidably received in a cylinder of corresponding dimension, the means for generating a servo pressure signal supplies a substantially constant servo pressure signal to one end of the movable piston, and wherein the servovalves control the variable servo pressure signal applied to the opposite end of the movable piston.

9. The control system of claim 8 wherein the substantially constant servo pressure signal is applied to the smaller diameter end of the movable piston.

10. The control system of claim 9 wherein the electronic control means comprises: two independent electronic control circuits; electrical connecting means connecting each control circuit to one of the fluidic servovalves; switch means interposed between each control circuit and each fluidic servovalve; and; switch control means connected to each switch such that, at any given time, only one switch is closed.

11. The control system of claim 2 wherein the electronic control means comprises: two independent electronic control circuits; electrical connecting means connecting each control circuit to one of the fluidic servovalves; switch means interposed between each control circuit and each fluidic servovalve; and; switch control means connected to each switch such that, at any given time, only one switch is closed.

12. The control system of claim 2 wherein the movable piston has two ends of different diameter, each end slidably received in a cylinder of corresponding dimension, the means for generating a servo pressure signal supplies a substantially constant servo pressure signal to one end of the movable piston, and wherein the servovalves control the variable servo pressure signal applied to the opposite end of the movable piston.

* * * * *

UNITED STATES PATENT AND TRADEMARK OFFICE

CERTIFICATE OF CORRECTION

PATENT NO. : 4,561,470

DATED : December 31, 1985

INVENTOR(S) : BEZARD et al

It is certified that error appears in the above-identified patent and that said Letters Patent is hereby corrected as shown below:

Col. 3, line 25: "6 and 6." should read -- 6 and 6'. --.

Col. 3, line 64: "controls" should read -- controls --.

Col. 4, line 12: "controllin9" should read -- controlling --.

Col. 5, line 37: "20 and 30" should read -- 20' and 30' --.

Col. 5, line 53: "100" should read -- 100' --.

Signed and Sealed this

*Twenty-second* Day of *April 1986*

[SEAL]

*Attest:*

DONALD J. QUIGG

*Attesting Officer*

*Commissioner of Patents and Trademarks*